US006318042B1

(12) United States Patent
Bloom et al.

(10) Patent No.: US 6,318,042 B1
(45) Date of Patent: Nov. 20, 2001

(54) GRID SYSTEM FOR A SUSPENDED CEILING

(75) Inventors: Lars Bloom, Ängelholm; Tord Edvinsson; Magnus Mollborn, both of Helsingborg; Mikael Moller, Nyhamnsläge; Fredrik Nilsson, Helsingborg; Jan Wilkens, Höganas, all of (SE)

(73) Assignee: Ecophon AB, Hyllinge (SE)

( * ) Notice: Subject to any disclaimer, the term of this patent is extended or adjusted under 35 U.S.C. 154(b) by 0 days.

(21) Appl. No.: 09/603,920

(22) Filed: Jun. 26, 2000

(51) Int. Cl.[7] ..... E04F 13/08
(52) U.S. Cl. ..... 52/506.07; 52/665; 52/669
(58) Field of Search ..... 52/506.07, 506.08, 52/506.09, 506.1, 664, 665, 666, 667, 668, 669, 220.6, 662

(56) References Cited

U.S. PATENT DOCUMENTS 3,969,865 * 7/1976 Andersen ..... 52/506.07
4,545,165 * 10/1985 Carey et al. ..... 52/506.07
4,658,562 * 4/1987 Brugman ..... 52/665
6,047,517 * 4/2000 Vrame ..... 52/506.07
6,077,593 6/2000 Schlachter .
6,103,360 8/2000 Caldwell et al. .

* cited by examiner

*Primary Examiner*—Michael Safavi
(74) *Attorney, Agent, or Firm*—Oblon, Spivak, McClelland, Maier & Neustadt, P.C.

(57) ABSTRACT

A grid system for a suspended ceiling comprising mutually spaced main runners of T-profile suspended by means of hangers at the web of the T-profile, the flanges of the T-profile forming support surfaces for tiles. Apertures are punched at regular spacing in the web of the T-profile registering transversely of the main runners. Channeled girders opening upwards and extending over several main runners along registering apertures therein engage the main runners to define the spacing therebetween, the web of the T-profile being received in slots in the bottom and side walls (18) of the channeled girder. Each girder is fixedly connected with the runners by fastening elements engaging the apertures therein.

7 Claims, 5 Drawing Sheets

GRID SYSTEM FOR A SUSPENDED CEILING

BACKGROUND OF THE INVENTION

1. Field of the Invention

This invention relates to a grid system for a suspended ceiling of the kind comprising mutually spaced main runners of inverted T-profile suspended by means of hangers at the web of the T-profile, the flanges of the T-profile forming support surfaces for tiles, apertures punched at regular spacing in the web of the T-profile registering transversely of the main runners, and mutually spaced cross spacers engaging the main runners and defining the spacing therebetween.

The tiles demountably supported by the grid system conceal this system, the linear joints between adjacent tiles being visible as a rectangular pattern on the lower side of the ceiling.

2. Description of the Prior Art

Grid systems of the kind referred to above are marketed by Ecophon AB, Hyllinge, Sweden, under the trade mark Focus D. The main runners in this prior art grid system are of a reliable construction and are used also in other grid systems marketed by Ecophon AB. They are manufactured in large quantities, which keeps the price of such runners at a low level. The apertures in the web of the T-profile are punched with great accuracy. The spacers comprise L-profiles forming slots in one flange thereof to receive the main runners therein. Each spacer spans the distance between two adjacent main runners only and is located in an arbitrary displaced position along the main runners. No means are provided in order to fix the spacers in the position that has been chosen.

U.S. Pat. No. 4,089,146 discloses a grid system for a suspended ceiling with asymmetric main runners comprising rather elaborate box profiles. The main runners each form a flange for supporting a tile at one edge thereof and are combined with separate cross bars supporting the tile at two other edges thereof. Spacers of V-shaped cross section are mounted on the main runners receiving the box profile in a notch in the spacer.

3. Problem Involved

Prior art grid systems of the kind referred to above do not provide the rigidity that is necessary in order to maintain by accuracy the regularity and the right-angled shape of the rectangular pattern formed by the tiles. It follows that the lines formed at the joints between adjacent tiles at the lower side of the ceiling may vary in width and linearity, and that the tiles eventually may be slightly displaced in relation to each other after mounting, which may afford to the ceiling an unpleasant appearance.

BRIEF SUMMARY OF THE INVENTION

A primary object of the invention is to overcome said problem and to provide a grid system of the kind referred to above which rigidly supports the tiles in a rectangular pattern and maintains the tiles in such pattern in order to secure a permanently attractive appearance of the ceiling.

This object is achieved by the invention which provides a grid system for a suspended ceiling comprising mutually spaced main runners of T-profile forming a web and two flanges, hangers suspending the main runners at the web of the T-profile, the flanges of the T-profile forming support surfaces for tiles, apertures punched at regular spacing in the web of the T-profile registering transversely of the main runners, mutually spaced cross spacers engaging the main runners and defining the spacing therebetween, each cross spacer comprising a channeled girder having bottom and side walls and opening upwards said channeled girder extending over several main runners along registering apertures therein and forming slots in the bottom and side walls, the web of the T-profile being received in said slots, and fastening elements fixedly connecting each girder with the runners by engaging the apertures therein.

In a preferred embodiment of the invention the fastening elements each comprise a split pin having two limbs one of which is passed through an aperture in the main raunner and engages the bottom of the channeled girder, said bottom being slightly V-shaped to form a longitudinally extending central depression, while the other limb engages the upper edge of the web of a main runner.

The stop clip preferably is T-shaped the stem of the T being constructed for insertion through the aperture with the cross bar of the T located on one side of the main runner, the stem of the T forming latching flaps for engagement with the opposite side of the main runner

BRIEF DESCRIPTION OF THE DRAWINGS

The invention will be described in more detail with reference to the accompanying drawings which disclose an illustrative embodiment of the invention and wherein.

DETAILED DESCRIPTION OF THE INVENTION

Figure 1:
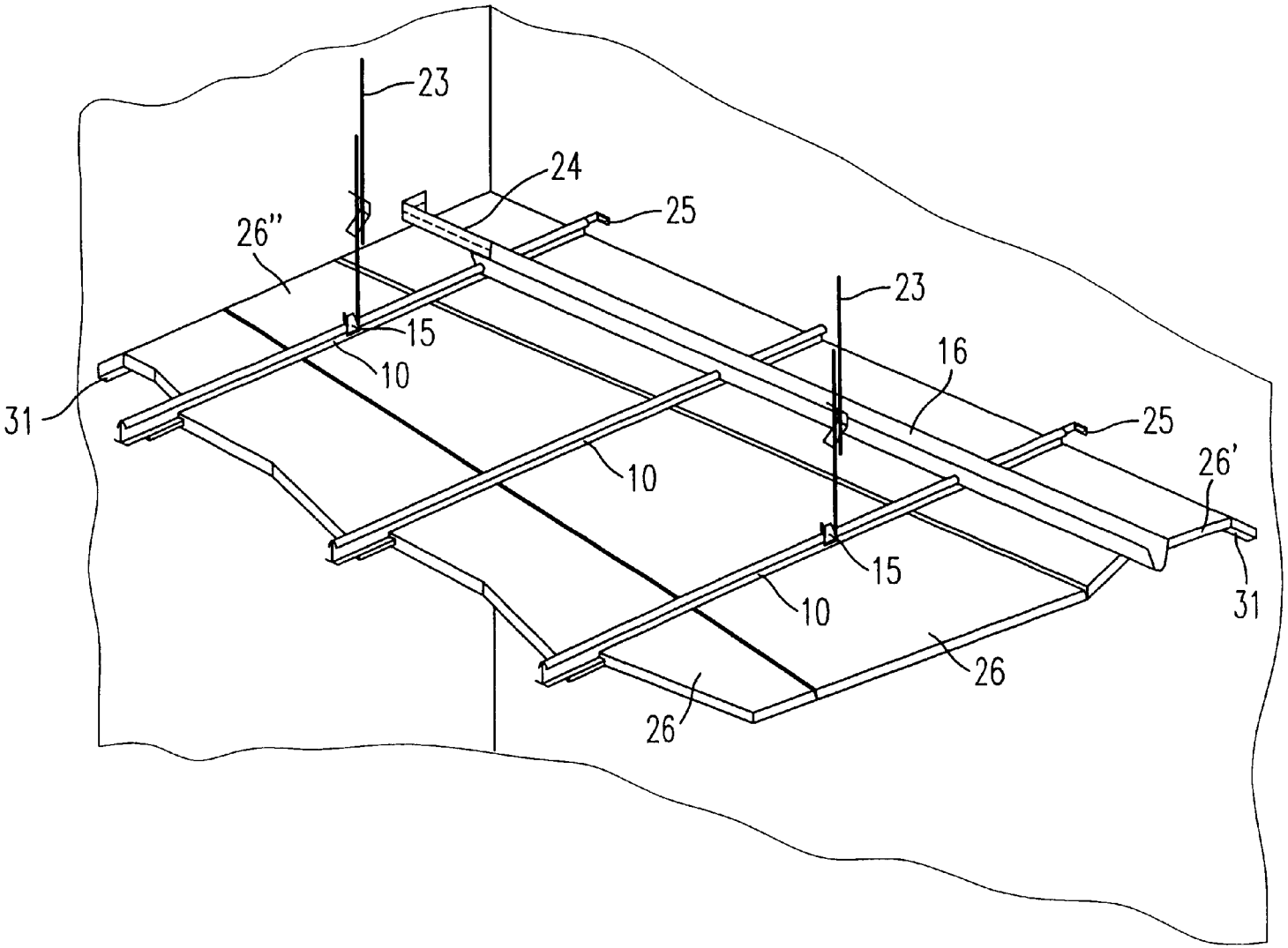
FIG. 1 is a fragmentary perspective view of a suspended ceiling with a concealed supporting grid system according to the invention.

The grid system for a suspended ceiling disclosed in the drawings comprises main runners 10 of inverted T-profile which are of a wellknown construction. Each runner is made of a strip of a metal sheet blank which is double folded to form the web 11 of the T-profile of double metal sheet layers which are bent perpendicularly outwards at opposite sides of the web to form the flanges 12 of the T-profile at one longitudinal edge of the web. The edges of the flanges 12 are folded over to form a stiffening edge bead. The web forms a stiffening hollow portion 13 along the other longitudinal edge of the web.

Figure 4:
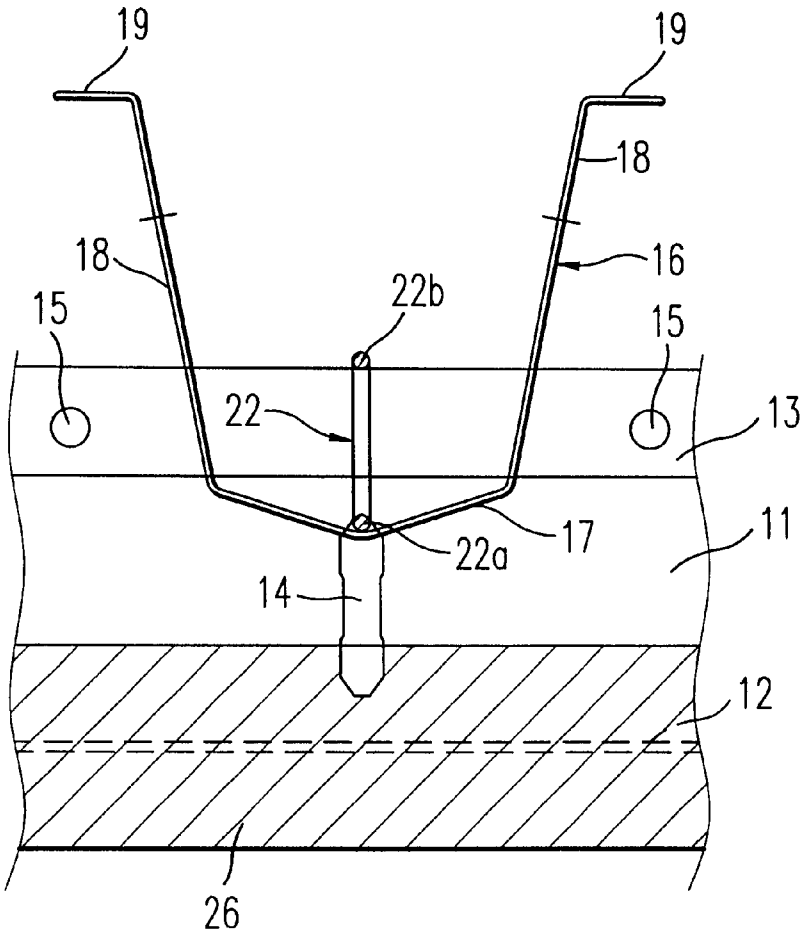
FIG. 4 is a cross sectional view along line IV—IV in FIG. 2.

Vertical slots 14, FIG. 4, are punched in the web 11 and are mutually spaced at regular intervals, defined by great accuracy, in the longitudinal direction of the runner. In the hollow portion 13 also circular apertures 15 are punched at regular intervals.

Figure 3B:
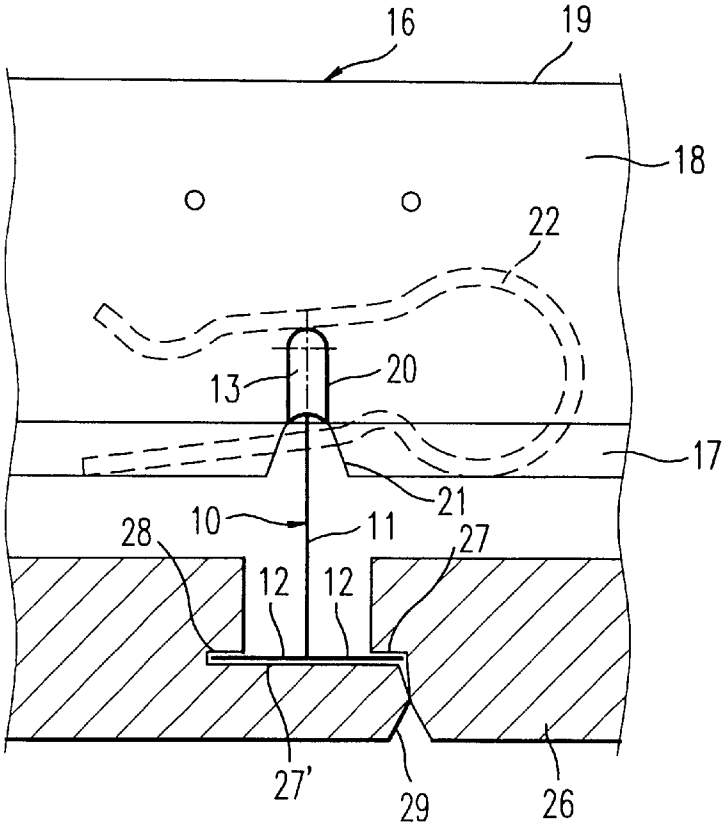
FIG. 3 is a cross sectional view along line III—III in FIG. 2.
Figure 3A:
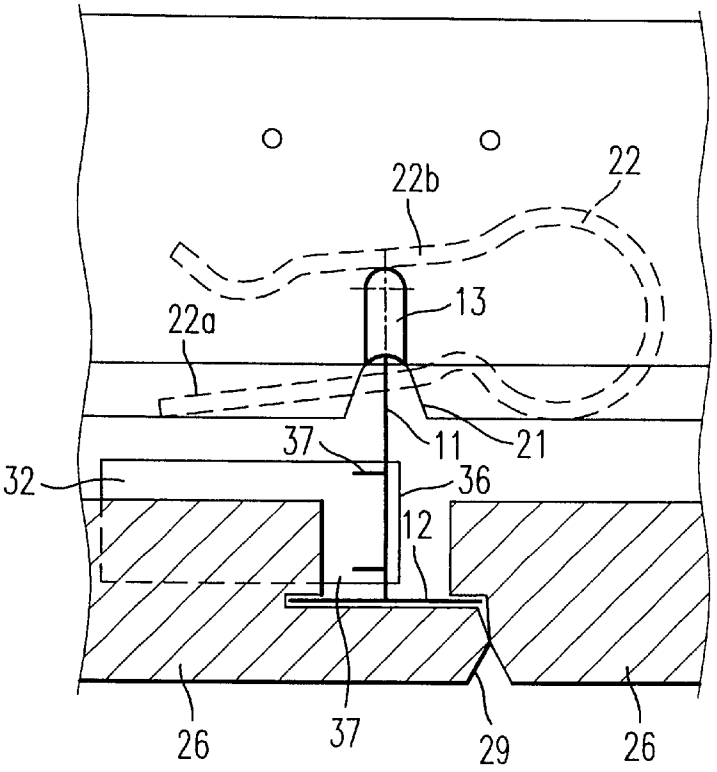

The main runners 10 extend in parallel mutually spaced in the transverse direction thereof and with the slots in register in the transverse direction of the runners. The runners are fixedly secured in this position by cross girders 16 comprising channel profiles with a bottom 17 and side walls 18 which form outwardly angled edge flanges 19, FIG. 4, so that the cross girders are very stiff against bending. The bottom 17 is slightly V-shaped. The cross girder forms slots 20 which extend through the bottom and partly into the side walls of the cross girder and are mutually spaced at intervals which are defined by great accuracy. Each cross girder extends over several main runners and is engaged with each runner at a slot the hollow edge portion of the main runner being inserted into the slot and has tight fit therein. The slot is flared in the bottom 17 as shown at 21 in FIG. 3 in order to facilitate the insertion of the main runner into the slot. The cross girder is located along registering slots 14 in the main runners and are fixedly connected with the main runners by means of split pins 22 which are inserted at one limb 22A thereof into a slot 14 said limb engaging the bottom 17 centrally thereof, while the other limb 22B engages the main runner at the edge of the web 11. Cross girders are distributed along the main runners at suitable intervals.

The grid system consisting of the main runners 10 and the cross girders 16 is suspended from the building structure by means of adjustable hangers 23 which are engaged with the main runners at the slots 14 or at the apertures 15 and are secured in the building structure in which the suspended ceiling is mounted. The ceiling is also secured to the walls of the building structure, by means of brackets 24 connected with the cross girders 16, and brackets 25 connected with the main runners 10.

The grid system constructed and suspended as described above provides a very sturdy and rigid support for the tiles, which affords great dimensional accuracy to the ceiling and maintains the rectangularity of the system.

The grid system described has been developed for supporting acoustic tiles 26 having a core of fiber material such as glass wool but can be used with tiles of any type. As shown in the drawings the tiles 26 has at one edge a narrow shoulder 27 and at the opposite edge a wider shoulder 27' which continues into a slot 28. At the lower side of the tile the edges are slightly chamfered at 29. The tile is supported at the shoulder 27 on one flange 12 of a runner 10 while the other flange 12 of an adjacent runner 10 is inserted into the slot 28. Then, the shoulder 27' covers substantially totally the lower side of the flanges 12. Adjacent tiles abut each other at the edges. The grid system is thus completely concealed by the tiles mounted in the grid system. The tiles can easily be mounted and demounted by slightly lifting the edge forming the shoulder 27 and then displacing the tile so that the flange is pushed into or out of, respectively, the slot 28.

At the edges 30 perpendicular to the edges forming the shoulders 27 and 27', respectively, adjacent tiles join each other edge to edge.

Figure 2:
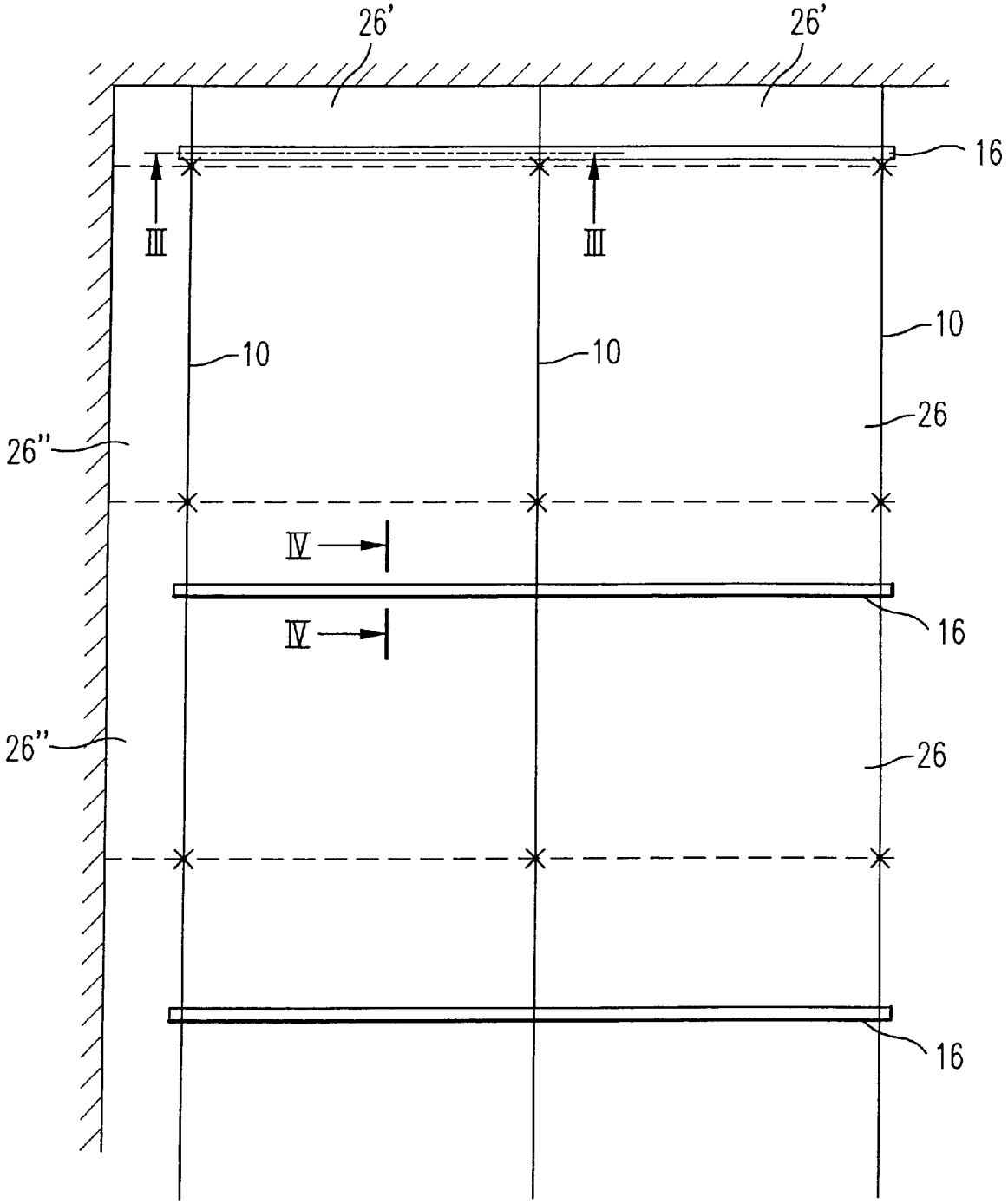
FIG. 2 is a plan view of the grid system with tiles showing the lay-out thereof.

All tiles should have a modular size but at the walls it may be necessary to cut the tiles to another size as shown in FIGS. 1 and 2 at 26' and 26", and these tiles must have a short measure. They are supported by trim bars 31 secured to the walls of the building structure.

Figure 5:
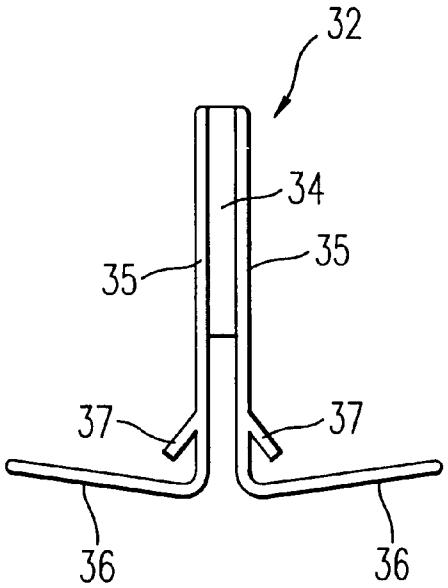
FIG. 5 is a plan view of a stop clip.
Figure 7:
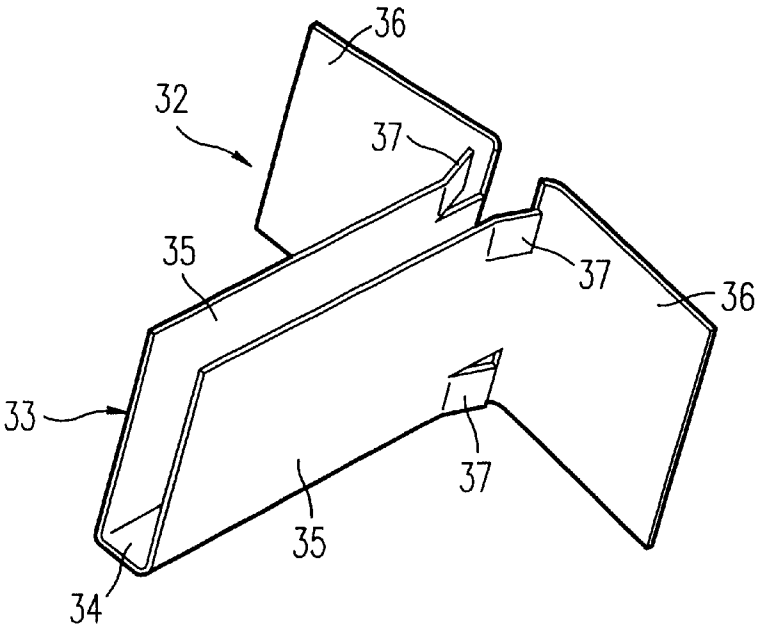
FIGS. 6 and 7 are a perspective views of the stop clip in FIG. 5 from opposite sides.
Figure 6:
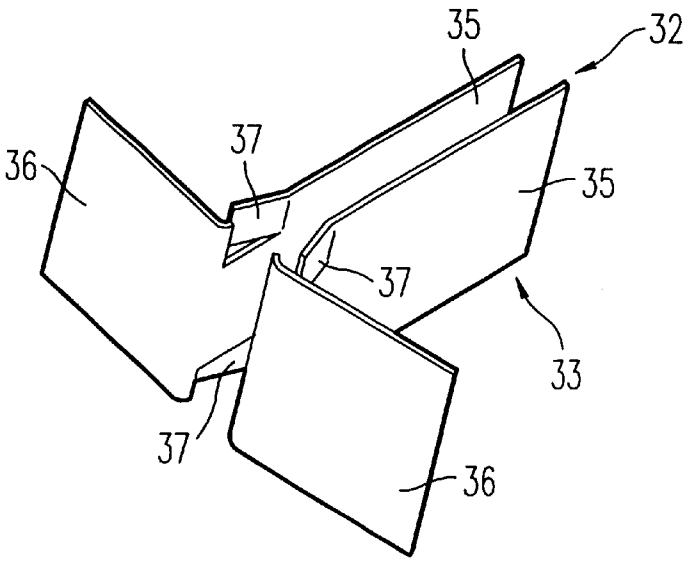

When the tiles have been engaged with the main runners at flanges 12 and are displaced along the runners in order to be brought into abutting relationship at the edges, the linearity of the lines defining the rectangular pattern on the lower side of the suspended ceiling by the butt joints between the edges 30 may be disturbed, when several tiles are located in a row along the main runners, due to manufacturing tolerances of the tiles or due to the fact that the tiles 26' which deviate from the modular size cannot be cut to the necessary dimensions with the accuracy applied in the factory to tiles of modular size. This means that the regularity of the rectangular pattern aimed at by providing a rigid rectangular grid system as proposed according to the invention will be lost. In order to overcome this disadvantage the invention provides the stop clip 32 disclosed in FIGS. 5 to 7 in the drawings. The stop clip is made of spring steel. It is T-shaped and comprises a U-shaped stem 33 with a web 34 and limbs 35 projecting at one end of the stem beyond the web and angled in opposite directions to form flanges 36. At the upper and lower edges of the limbs 35 flaps 37 are punched from the limbs and project on the outside thereof at acute angle towards the adjacent flanges 36 with the tips of the flaps slightly spaced from the flanges.

The stop clip as described can be placed in a main runner by inserting the stem 33 in a slot 14 where two adjacent tiles abut each other. At the insertion the flaps 37 will be resiliently depressed and then will spring back to latchingly engage behind the web of the runner so that the stop clip will be securely fastened to the runner. By inserting stop clips at suitable intervals corresponding to a desired number of tiles and particularly between the tiles 26' and the adjoining tiles 26 the influence on the linearity of the lines formed at the edges running perpendicularly to the main runners 10 on the lower side of the ceiling will be eliminated or minimized. The tiles 26' in a row may be disposed to close to the wall so that the gap between the tiles 26' and the adjoining tiles 16 will be too wide, but the tiles 26 in the row are fixedly positioned by the clips. If the tiles 26 have a minimum tolerance, this tolerance will be equalized at each clip so that accumulation of the tolerance along the row, affording an irregular appearance to the lower face of the ceiling, will be avoided.

What is claimed is:

1. A grid system for a suspended ceiling comprising mutually spaced main runners of T-profile forming a web and two flanges, hangers suspending the main runners at the web of the T-profile, the flanges of the T-profile forming support surfaces for tiles, apertures punched at regular spacing in the web of the T-profile registering transversely of the main runners, mutually spaced cross spacers engaging the main runners and defining the spacing therebetween, each cross spacer comprising a channeled girder having bottom and side walls and opening upwards said channeled girder extending over several main runners along registering apertures therein and having slots in the bottom and side walls, the web of the T-profile being received in said slots, and fastening elements fixedly connecting each girder with the runners by engaging the apertures therein.

2. The grid system of claim 1 wherein said fastening elements each comprise a split pin having two limbs one of which is passed through the aperture (14) and engages the bottom of the channeled girder while the other limb engages the upper edge of the web of a main runner.

3. The grid system of claim 2 wherein the bottom of the channeled girder forms a longitudinally extending central depression.

4. The grid system of claim 3 wherein the bottom of the channeled girder is slightly V-shaped.

5. The grid system of claim 1 further comprising at least one stop clip inserted in one of said apertures in the main runners at the joint between two adjacent tiles supported by the grid system.

6. The grid system of claim 5 wherein the stop clip is T-shaped the stem of the T being constructed for insertion through the aperture with the cross bar of the T located on one side of the main runner.

7. The grid system of claim 6 wherein the stop clip forms latching flaps on the stem of the T for engagement with the opposite side of the main runner.

* * * * *